United States Patent [19]

Tomibe et al.

[11] 3,998,585

[45] Dec. 21, 1976

[54] PACKAGE DYEING METHOD

[75] Inventors: Shinji Tomibe; Michio Arai; Kiyoshi Higashi, all of Kyoto, Japan

[73] Assignees: Kuraray Co., Ltd.; Nippon Sanmo Sensyoku Co., Ltd., both of Japan

[22] Filed: July 3, 1975

[21] Appl. No.: 592,988

[30] Foreign Application Priority Data

July 18, 1974 Japan ..... 49-82475

[52] U.S. Cl. ..... 8/19; 8/150; 8/155.2; 8/156

[51] Int. Cl.[2] ..... D06P 7/00; D06B 5/00

[58] Field of Search ..... 8/19, 150, 155.2, 156

[56] References Cited

UNITED STATES PATENTS 2,552,078 5/1951 Williams ..... 68/44

OTHER PUBLICATIONS

*Dyeing & Chemical Technology of Textile Fibres,* Trotman, 1964, pp. 297–299.

*Primary Examiner*—John Kight, III

*Attorney, Agent, or Firm*—Bierman & Bierman

[57] ABSTRACT

A batchwise packaging dyeing method is disclosed wherein a loose stock of fiber is charged into a basket carrier of a high temperature, high pressure package dyeing machine. The loose stock of fiber is charged in such a manner that the change rate (a) is 10% or less and is defined as the difference between the open space value before dyeing ($E_1$) of the fiber layer and the open space value after dyeing ($E_2$) of the fiber layer.

16 Claims, No Drawings

PACKAGE DYEING METHOD

BACKGROUND AND OBJECTS OF THE INVENTION

This invention relates generally to an improvement in the package dyeing of loose stock of loose stock of various fibers. More particularly, the invention relates to a novel, batch-wise package dyeing method in which a loose stock of a fiber is subjected to washing and cleaning, and if required, further to hot rinsing while the loose stock is being charged or loaded in a basket carrier.

In accordance with a customary method of loose stock dyeing, various natural, chemical and synthetic fibers such as wool, cotton and the like are first charged into a basket carrier. The basket carrier has a dough-nut-shaped cross section and a number of liquid passage apertures disposed on both the internal and external walls thereof. The basket carrier is then placed in the dyeing of a high temperature high pressure package dyeing machine kettles. Dyeing liquid is then circulated therethrough as, for example, from the interior to the outside so as to effect the dyeing of the loose stock.

Generally, the method of loose stock dyeing of the above-described type is referred to as "package dyeing". A Calle Baut dyeing machine or an Obermaier dyeing machine is used for this purpose.

This dyeing process necessarily involves past dyeing treatments such as washing and rinsing. These treatments are effected after an aggregate of the fiber, which has been compacted in the basket during the dyeing step, is withdrawn therefrom. For example, the treating liquids are applied to the fiber thus opened during transfer of the fiber by a conveyor, or alternatively the opened fiber is transferred inside the treating liquids by means of a fork.

Accordingly, the customary package dyeing method has various defects such as being extremely slow, requiring large sized apparatus and therefore, complicated operations, large amounts of labor, and so forth. In addition, the fiber thus dyed by the customary method is not free from various defects such as frequent uneven dyeing, entaglement of fibers (which lowers the spinnability of the fiber), foreign matter in the fiber during processing, and the like. All of these defects cause deterioration of the final product.

The primary object of the present invention is to provide a simplified batchwise package dyeing method which makes it possible to carry out the dyeing, washing and rinsing in sequence while a loose stock of a fiber is a basket carrier.

Another object of the present invention is to provide a batchwise package dyeing system wherein a loose stock of a fiber is dyed satisfactorily, free from uneven dyeing and uneven treatment and without admixture of foreign matter. This is accomplished by circulating high temperature, high pressure dyeing liquids through the loose stock, washing and rinsing while a densely packed loose stock of the fiber is in a basket carrier.

It is still another object of the present invention to provide an economical batchwise package dyeing system by the use of a treating apparatus consisting of a small conventional dyeing tank. A simplified procedure can be employed, wherein a loose stock of a fiber is subjected to the sequential treatments of dyeing, washing and rinsing followed by a drying treatment while the loose fiber is in a basket carrier. This is further followed by packaging the treated fiber as it is discharged from the basket carrier.

In accordance with the present invention, a fiber is first charged in a basket carrier of the type which is generally employed in the art. Thereafter it is treated with a circulating dye bath, washing bath, and rinsing bath in a regular sequence. This is performed while the fibers are in the basket carrier inside a dyeing kettle of a high temperature, high pressure package dyeing machine. In this instance, it is imperative that the fiber is charged with a high loading density in the basket carrier.

The loading density of the fiber in a package dyeing method of the customary type is usually 200 g/l in the case of a polyester fiber, and 270 g/l for a polycarcylonitrile fiber. If the loading density of the fiber is within this range, the volume of the fiber layer inside the basket carrier decreases. This reduces the space between the fibers of the fiber layer, thus causing the permeability of the treating liquids to be remarkably lowered.

If the fiber is treated in the same package for an extended period of time space is developed between the fiber layer and the internal wall or lid plate of the basket. Thus, the treating liquids, proceed through this space and a turbulent flow is generated whereby the treating liquids do not permeate uniformly through the aggregate fiber. As a result, portions of the fiber in the proximity of the space between the fiber and the lid plate are thrown into disorder by the treating liquids resulting in entwinement and entanglement. This results in a reduction of the spinnability of the fiber in the subsequent spinning process.

Accordingly, if the fiber is kept in this state, the treating liquids never pass through the aggregate fiber uniformly, which prohibits the uniform treatment of the fiber. At the same time, entwinement and entanglement of the fiber are further enhanced. Therefore, it is not feasible to carry out the treatments of dyeing, washing, rinsing and drying in a single package.

In the present invention, it is therefore required that the fiber be charged with a high loading density in a basket carrier so that a change rate (a) between the open space value of the fiber layer before the dyeing treatment and the open space value thereof after the dyeing is 10% or less. The term "open space value" is defined by the following formula;

$$\epsilon = 1 - \rho_v/\rho_f$$

where $\epsilon$ is the open space value;

$\rho_v$ is the apparent loading density (g/cm$^3$) of the fiber layer charged in a basket; and $\rho_f$ is the actual density (g/cm$^3$) of the fiber.

Accordingly, the abovementioned "change rate (a)" of the rate of vacant space before and after the dyeing is represented by the following formula;

$$a = \frac{\epsilon_1 - \epsilon_2}{\epsilon_1} \times 100$$

where $\epsilon_1$ is the rate of open space value of the fiber layer before dyeing; and $\epsilon_2$ is the open space value of the fiber layer after dyeing.

Further, the above-mentioned loading densities $\rho_{P1}$ and $\rho_{P2}$ are represented by the formula;

$$\rho_{P1} = \frac{W}{V1}, \quad \rho_{P2} = \frac{W}{V2}$$

where

V is a weight of fibers charged in the basket carrier;

V1 is the apparent volume of fiber layer in the basket carrier before dyeing; and V2 is the apparent volume of fiber layer in the basket carrier after dyeing.

The loading of the fiber layer may also be determined either by loading density or by the open space value of the fiber layer. In the present invention, however, it is an essential requirement that the change rate (a) of the open space values of the fiber layer before and after the dyeing treatment should always be kept at 10% or less regardless of the kind of fiber dyed. Even if the loading density of the fiber layer is extremely high when it is initially filled in a basket carrier, the open space value after the dyeing treatment tends to be lowered remarkably depending on the type of fiber, its denier, length, dyeing conditions and the like. At times, open space value of the fiber layer after the dyeing treatment is lowered drastically, and the volume of the fiber layer inside the basket decreases to the extent tha the subsequent treatments such as cleaning, washing and oiling can not be uniformly carried out.

The inventors have made extensive studies in search for a method to solve the abovementioned problems. As a result, the inventors hae found that the problems can only be solved by considering the change rate of the open space values of the fiber layer before and after the dyeing treatment. If said change rate is retained in the range of 10% or less, the fiber layer inside the basket carrier can be maintained constant through out each of the subsequent treatments. This includes the time prior to and during the dyeing treatment. This results in preventing turbulent flow of the treating liquids and allows a laminar flow of each treating liquid to pass through the fiber layer uniformly.

The inventors have thus confirmed that the fiber layer can be treated uniformly when the change ratio is kept at 10% or less.

When various fiber layers have the open space value before dyeing as illustrated in Table 1, the change rate of the open space values before and after the dyeing treatment of the fiber layer is kept substantially in the range of 10% or less so as to thereby accomplish the objects of the present invention.

Table 1

| Fiber Material | Open space valve before dyeing | Dyeing Conditions |
|---|---|---|
| Polyester fiber 2 dr × 51 mm | less than 0.75 preferably 0.70 to 0.65 | Disperse dyes 130° C, 120 minutes |
| Polyacrylic fiber 2 dr × 51 mm | less than 0.61 preferably 0.56 to 0.47 | Cationic dyes 100° C, 60 minutes |
| Rayon staple fiber 2 dr × 51 mm | less than 0.85 preferably 0.80 to 0.73 | Reactive dyes 80° C, 110 minutes |
| Polyamide fiber 15 dr × 100–120mm | less than 0.65 preferably 0.65 to 0.56 | Acid dyes 100° C, 110 minutes |
| Wool fiber | less than 0.80 preferably 0.80 to 0.70 | Acid dyes 100° C, 110 minutes |
| Vinylon fiber 3 dr × 76mm | less than 0.75 preferably 0.75 to 0.60 | Basic dyes 100° C 60 minutes |

The loading of the fiber to achieve the necessary high density can not be achieved by a customary stamping machine. It requires adequate compression by means of a press machine or similar device. Pressure in this instance varies depending upon the type of fiber, the method of fiber filling such as dry-type or wet-type and other factors, but is usually selected in the range of 0.56 kg/cm$^2$ to 6.5 kg/cm$^2$. For this reason, the basket carrier used in the present process must be more rigid than the customary type.

The charging or loading of fibers into the basket carrier in a high density can be carried out by the operation which comprises placing a double type case having the same inner diameter and outer diameter as the basket carrier upon the basket carrier, charging the fibers in said case and basket carrier, compressing said fiber layer to load from the case to the basket carrier in a high density and finally removing the case from the basket carrier.

In accordance with the present ivnention, a fiber is loaded in a basket carrier in such a high density, then placed in a treating kettle of a package dyeing machine, and thereafter subjected to the treatments of dyeing, washing and rinsing in regular sequence. The treating kettle used in this invention is of the same type used in conventional package dyeing machines. Preferred examples of the conventional package dyeing machines include a Calle Baut dyeing machine, an Obermaier dyeing machine and the like.

In practicing the dyeing treatment in accordance with the present invention, the basket carrier, having the fiber loaded therein, is placed in a treating kettle of a package dyeing machine. In this instance, permeation resistance of the dyeing liquid through the fiber layer is naturally increased; Thus, the pumping pressure of the dye liquid feed pump must be correspondingly increased. The optimum relationship between the open space value of the fiber layer, the pump head and the liquid flow, for various fibers, is illustrated in Table 2.

Table 2

| Kind of Fiber | Loading Density (g/l) | Open space Valve (ε) | Pump Head (mAq.) | Liquid Flow (l/sec.kg) |
|---|---|---|---|---|
| Rayon staple | 300 | 0.80 | 18 | 0.25 |
| 2.0d × 51m/m | 350 | 0.77 | 32 | 0.25 |
| Polyester | 400 | 0.70 | 14 | 0.33 |
| 2.0d × 51m/m | 450 | 0.67 | 18 | 0.33 |
| Acrylic | 500 | 0.56 | 20 | 0.25 |
| 2.0d × 51m/m | 550 | 0.52 | 33 | 0.25 |

Because the dyeing liquid flows uniformly through the fiber layer during of the dyeing treatment, there is obtained a high degree of dye absorption as well as uniform dye absorption of the fiber. Further, the amount of the washing and rinsing liquids is found to be about half the conventional amount since the loading density is raised remarkably in the present invention.

In accordance with the present dyeing method employing a high pump head [measured in meters of water (mAq.)] and corresponding flow rate, it is possible to employ a centrifugal pump in order to carry out the operation with a higher efficiency. A pressure of 1 mAq is defined as the equivalent of 1 kg/cm$^2$.

After the dyeing treatment has been completed and the dyeing liquid has subsequently been extracted from the treatment kettle in accordance with the present invention, a washing liquid used commonly in the art or hot water can be supplied under a high pressure. This is accomplished by the use of the dye liquid feed pump in the same manner as in the dyeing treatment. The fiber layer can be washed by circulating said washing liquid or hot water through the fiber layer while the fiber layer is in the basket carrier.

Moreover, after the washing liquid or hot water has been extracted from the treating kettle, the fiber layer can be treated with a rinsing liquid which is widely used in the art. It is supplied to the treating kettle under high pressure by means of the dye liquid feed pump as in the steps of dyeing and washing.

A conventional method of simply increasing the amount of the washing and rinsing liquids is not sufficient for the purpose of enhancing the effects of the washing and rinsing treatments. Various methods can be used in the present invention as a means of discharging water and/or dehydration. For example, a method in which each treating liquid is discharged under pressure without being cooled. Another example is a method of water discharge using a blower. A third example is the use of a centrifugal separation/dehydration method. Similar methods to the one mentioned can be employed. Whatever method selected it is to be used between each of said treatments.

Likewise in practising the washing and rinsing treatments in the present invention, it is advisable to feed a pre-heated treating liquid for a subsequent treatment to the treating kettle in order to maintain the temperature of the fiber layer. This is helpful in preventing soil redeposition of the fiber by scums including oligomers that are extracted during the treatments of dyeing, washing and the like.

As noted, the treatments from dyeing to rinsing can be effected in a regular sequence by the use of a single treating kettle in the present invention. However, separate treating kettles may also be used in the present invention one can be used as the dyeing bath for the dyeing treatment and, if desired, a part of the washing treatments. The other treating kettle can be used for the rinsing treatment including the remaining part of the washing treatment.

The use of the two treating kettles results in an improved efficiency of the treatments. This is because the time required for the dyeing treatment is extremely longer than the time required for the rinsing treatment. Cleaning of the dyeing machine calls for an extra washing with warm water, resulting in decreasing the effective use of the treating kettle. Similarly, when a number of fibers are repeatedly dyed in the same color, it is preferred to employ a separate treating kettle for the rinsing treatment. After each treatment the fiber layer can be dried while in the basket carrier. In this case, considerable amounts of Blower flow and blower passing resistance are naturally required for drying. Fiber layers filled in the basket carrier in a loading density illustrated in the aforementioned Tables 1 and 2, and in a quantity tabulated below can be dried uniformly by passing hot air into the treating box for 30 to 50 minutes under the following conditions

| | |
|---|---|
| air pressure | 618 – 735 mmHg |
| air flow | 70 – 100 m³/minute |
| temperature | 80 – 90° C. |
| Polyester fiber | 400 Kg |
| Polyacrylic fiber | 500 Kg |

-continued

| | |
|---|---|
| Rayon staple fiber | 300 Kg |

Drying can be effected in the customary manner after withdrawing the fiber layer from the basket carrier by means of a suction drum dryer or like devices. If the drying is carried out while the fiber layer is kept in a packaged condition in the basket carrier, that the fiber layer after the drying (which has a doughnut shape) can be advantageously crushed and packaged.

Thus in accordance with the present invention, the fiber can be subjected to dyeing, washing and rinsing treatments in regular sequence while it is kept in the basket carrier. Accordingly, procedures are simplified in the present invention to a great extent and lead to savings in the cost of production. Furthermore, the amount of the treating liquids, the amount of water required for dyeing, and the amount of discharge water can be remarkably reduced.

Since the treating liquids can pass through the fiber layer uniformly, the treating effect is uniform thereby eliminating the occurrence of uneven dyeing. Further, entanglement of the fiber in the fiber layer after each of the treatments is also remarkably reduced. This insures a good opening property at the time of spinning and reduces neps and slabs of the spun yarns.

Even in the case of potentially crimpable fibers such as a conjugated fiber, crimping of the fiber does not take place during the dyeing treatment because the fiber is maintained in a constant condition. Accordingly, the spinnability of the fiber after the treatments is extremely improved.

The method of the present invention can also be applicable to the dyeing of staple fibers (raw stock), sliver, tow and top of various fibers including natural fibers, chemical fibers and synthetic fibers.

The present invention will be made more apparent by referring to Examples in the paragraphs to follow.

These examples are presented for illustrative purposes and are not meant to limit the present invention in any manner.

EXAMPLE 1

200 Kilograms of a polyester fiber (2.0 d × 51 mm) were charged into a basket carrier having an inner diameter of 600 mm and an outer diameter of 1010 mm with the application of pressure using a stamping machine, compressed to an open space value before dyeing rate of 0.70 (loading density 400 g/l) under a pressure of 2.8 kg/cm² using a press machine, and then introduced to a high-temperature high-pressure package dyeing machine (Hisaka Works Ltd. Japan). The dyeing was effected by supplying the below-mentioned dyeing liquid by means of a pump with a pump head of 10 m Aq. and liquid flow rate of 0.33 l/sec. Kg for 40 minutes.

| | |
|---|---|
| Kayalon polyester sapphire Blue GFGLE (C.I. Disperse Blue 108) | 2.7% O.W.F. |
| Diamix Blue BGFS (C.I. Disperse Blue 113) | 2.16% O.W.F. |
| Acetic acid (80%) | 1.0cc/l |
| liquid temperature | 130° C |

After the dyeing was finished, the dye liquid was quickly drained at 120° C to 130° C The rate open space value after the dyeing was 0.69 (loading density 429 g/l), and the change rate of the fiber layer in the basket carrier was 1.5%.

After the liquid was drained, an alkali reduction cleaning liquid composed of 2.0 cc/l of caustic soda (71.4Tw 32.5%), 2.0 cc/l of Amiradine (nonionic surfactant: Daiichi Kogyo Seiyaku Co., Ltd. Japan) and 2.0 g/l of hydrosulfite maintained at 80° C was supplied to the dye bath by means of said pump to perform treatment at 80° C for 15 minutes by circulating the liquid. The liquid was then quickly drained. Then the hot water maintained at 80° C was supplied to the dye bath using said pump to effect treatment for another 5 minutes at 80° C by circulating the water. The water was then drained. Then, the step of washing with hot water for 5 minutes at 80° C was repeated. The fiber in the basket carrier was then treated for 15 minutes at 40° C. using a rinsing agent of the following composition:

KY-207 (nonionic rinsing agent:
Yoshimura Yukagaku Co., Ltd., Japan) 38 g/l

Finally, the basket was transferred to a centrifugal hydroextractor. After the dehydration, the fiber layer was taken from the basket carrier and dried using a drum dryer. The following effects were obtained as compared to a conventional loose stock dyeing.

Change of fiber layer during dyeing: almost none
Disturbance of fiber during dyeing: alost none
Disturbance of fiber during dyeing: almost none
Amount of water used and amount exhausted: one-half
Expenses required for dye stuffs: reduced by 30%

The spinnability was greatly improved compared to the earlier methods.

Another batch of polyester fiber was charged into the basket carrier. This batch was characterized as having an open space value before dyeing of 0.86 (loading density 200 g/l) and was treated in the same manner as above. The results showed an open space value after dyeing of 0.70 (density 400 g/l and a change rate of 18%. The dyeing results showed that the central part of the fiber layer was somewhat dense in color, developing entanglement of the fiber, giving poor opening at the time of spinning compared to the process of the present invention, and producing more slab and nep of the spun yarn.

EXAMPLE 2

150 Kilograms of a rayon staple fiber (2.0 d × 51 mm) was charged into a basket carrier having an inner diameter of 600 mm and an outer diameter of 1010 mm with the application of pressure using a stamping machine. The fiber was compressed to an open space value before dyeing of 0.80 (loading density 300 g/l) under a pressure of 1.1 kg/cm$^2$ using a press machine. Then the fiber was introduced to a high-temperature, high-pressure package dyeing machine to effect dyeing for 40 minutes by supplying the below-mentioned dyeing liquid by means of a pump with a pump pressure of 11 m Aq. and liquid flow rate of 0.25 l/sec.kg.

| | |
|---|---|
| Diamira brilliant Blue R (C.I. Reactive Blue 19) | 3.5% o.w.f. |
| Diamira Turquoise Blue G (C.I. Reactive Blue 21) | 0.53% o.w.f. |
| Diamira Black B (C.I. Reactive Black 5) | 0.11% o.w.f. |
| Diamira brilliant Red 2B (C.I. Reactive Red 21) | 0.03% o.w.f. |

-continued

| | |
|---|---|
| Mirabilite | 90g/l |
| Soda ash | 20g/l |
| Liquid Temperature | 60° C |

After the dyeing was finished, the dye liquid was quickly drained.

The open space value rate after the dyeing was 0.79 (loading density 310 g/l), and the change rate was determined to be 1.25%.

Then, hot water maintained at 80° C, was supplied to the dye bath to effect treatment for 5 minutes at the same temperature, and then drained. The hot water, maintained at 80° C and containing 1.0 g/l of Sevlan No. 120 (anionic surfactant manufactured by Shichifuku Kagaku Co., Ltd., Japan) was supplied to the basket carrier to perform treatment at 80° C for 10 minutes by circulating the liquid. The liquid was then drained. The basket carrier was then removed and transferred to a centrifugal hydroextractor to effect dehydration for 5 minutes. The basket was then transferred to an oiling-agent treating bath and served with the hot water maintained at 80° C to effect treatment for 5 minutes by circulating the liquid. The fiber was then treated with 9 g/l of Honol As (anionic rinsing agent produced by Takemoto Yushi Co., Japan) at 40° C for 15 minutes. Finally, the basket carrier was transferred to a centrifugal hydroextractor. After the dehydration, the fiber layer was removed from the basket carrier and dried using a suction drum dryer. The fiber was dyed uniformly, exhibiting the following effects as compared to a conventional loose stock dyeing.

Amount of water used and exhausted: one-half
Expenses required for dyes, drugs and assisting agents: reduced by 30–40%

The spinnability was greatly improved.

EXAMPLE 3

Separate batches of 250 Kilograms of polyacrylic fiber (2.0 d × 51 mm) were charged into a basket carrier having an inner diameter of 600 mm and an outer diameter 1010 mm. These batches exhibited open space values before dying as shown in Table 3. The basket carrier was then transferred to a high-temperature, high-pressure package dyeing machine to effect dyeing for 40 minutes by supplying the below-mentioned dyeing liquid by means of a pump with a pump head of 15 mAq. and liquid flow rate of 0.25 l/sec.kg.

| | |
|---|---|
| Diacryl Yellow 3GN (C.I. Basic Yellow 51) | 0.1% o.w.f. |
| Maxilon Blue GRL (C.I. Basic Blue 41) | 1.5% o.w.f. |
| Maxilon Blue 5G (C.I. Basic Blue 3) | 1.5% o.w.f. |
| Acetic acid (80%) | 1cc/l |
| Liquid temperature | 100° C |

After the dyeing was finished, the dyeing liquid was quickly drained. Immediately thereafter, hot water, maintained at 80° C, was supplied to the dye bath to effect washing for 5 minutes at the same temperature, and the hot water was then quickly drained. The basket was then transferred to a rinsing agent treating bath of the same type as said dye bath and oiled at 50° C for 15 minutes using 100 g/l of Saphanol SAK-14 (cationic rinsing agent produced by Sanyo Kasei Co., Japan). Finally, the basket carrier was transferred to a centrifugal hydroextractor. After the dehydration, the fiber layer was removed from the basket carrier and dried using a drum dryer.

Table 3 shows open space values before dyeing, change rates of the open space values before and after dyeing, the dyed state and the spinnability. The results indicate that the fibers, having an open space value before dyeing of 0.82 and 0.74, were not uniformly treated, developed partial or complete, and developed increased disturbance of fibers accompanied by a considerable deterioration of spinnability. On the other hand, the fibers of the present invention were quite uniformly treated, without exhibiting the problems associated with dye spots and poor spinnability.

Table 3

| Number | Open space valve before dyeing | change rate | Uneven dyeing | Spinnability |
|---|---|---|---|---|
| 1 | 0.82 | 31.7 % | many partial spots | Large proportion not spinnable |
| 2 | 0.74 | 24.3 % | " | " |
| 3 | 0.65 | 13.9 % | Partial spots | Partly not spinnable |
| 4 This invention | 0.61 | 9.2 % | No spot | No unspinnable part |
| 5 This invention | 0.56 | 1.8 % | " | " |
| 6 This invention | 0.51 | 0 | " | " |

EXAMPLE 4

250 Kilograms of a polyacrylonitrile fiber (2.0 d × 51 mm) were charged into a basket carrier having an inner diameter of 600 mm and an outer diameter of 1010 mm with the application of pressure using a stamping machine. The fiber was compressed to an open space value before dyeing of 0.56 (loading density 500 g/l) under a pressure of 0.65 kg/cm² using a press machine. The fibers were then introduced into a high-temperature, high-pressure package dyeing machine to effect dyeing for 40 minutes. This was accomplished by supplying the below-mentioned dyeing liquid by means of a pump with a pump head of 16 mAq. and liquid flow rate of 0.25 l/sec kg.

| | |
|---|---|
| Diacryl Red MGL (C.I. NON, Basic Dye: Mitsubishi Kasei Co., Ltd.) | 3.8% o.w.f. |
| Diacryl Yellow 3GN (C.I. Basic Yellow 51) | 0.208% o.w.f. |
| Maxilon Blue GRL (C.I. Basic Blue 41) | 0.08% o.w.f. |
| Cathilon Brilliant Pink BH (C.I. Basic Red 36) | 10.0% o.w.f. |
| Acetic acid (80%) | 1.0 g/l |
| Liquid temperature | 100° C |

After the dyeing was completed, the dye liquid was quickly drained. Immediately thereafter the hot water, maintained at 80° C, was supplied to permit washing foq 5 minutes, and then quickly drained. The basket carrier was transferred to a rinsing-agent treating bath of the same type as the dye bath. There the air was blown at the fiber layer in the basket carrier from the outside toward the inside thereof with a wind pressure of 5000 mm Aq and a blowing rate of 28 m³/min, to effect blower dehydration. The hot water, maintained at 80° C, was then supplied to said treating bath for 5 minutes, and then drained. Blower dehydration was performed for 5 minutes in the same manner as mentioned above. 100 g/l of Saphanol AW-300 (cationic type rinsing agent produced by Sanyo Kasei Co., Japan) was supplied to perform treating at 50° C for 15 minutes. Finally, the basket carrier was transferred to a centrifugal hydroextractor and then transferred to a high-temperature, high-pressure package drying machine. The fiber layer was dried from the inside toward the outside thereof for 40 minutes and then from the outside toward the inner side thereof for 10 minutes by air having a temperature of 80° C., a wind pressure of 550 mmHg, and a flow rate of 60 m³/min. The fiber was dyed uniformly and, in addition, the fiber layer was uniformly dried in a condition ready for packaging.

We claim:

1. A package dyeing method which comprises:

a. charging a loose stock of fiber into a basket carrier of a high temperature, high pressure package dyeing machine, b. compressing said fiber to form a first fiber layer in such a manner that $\epsilon_1$, defined as $1-\rho_{P1}/\rho f$ where $\rho_{P1}$ is equal to $W/V_1$, is within the range of 0.47 and 0.85, c. circulating a dyeing liquid through said first layer, d. removing the excess dyeing liquid from said carrier to thereby obtain a second fiber layer having a value for $\epsilon_2$, defined as $1-\rho_{P2}/\rho f$ where $\rho_{P2}$ is equal to $w/v_2$, such that (a), defined as $$\frac{\epsilon_1 - \epsilon_2}{\epsilon_1} \times 100,$$

has a value of 10% or less, e. washing and rinsing said second layer while in said basket carrier, and wherein $\epsilon_1$ is the open space value of said first layer, $\epsilon_2$ is the open space value of said second layer, $\rho_{p1}$ is the apparent loading density of said first layer, $\rho_{P2}$ is the apparent density of said second layer, $\rho f$ is the actual density of said fiber, w is the weight of said fiber, $v_1$ is the apparent volume of said first layer, and $V_2$ is the apparent volume of said second layer.

2. The method of claim 1 further comprising:

a. feeding a pre-heated liquid into said basket carrier prior to said washing and rinsing, b. removing said liquids after each step of washing, and rinsing, and c. drying said fibers.

3. The method of claim 1 further comprising:

a. placing a circular case, having the same inner and outer diameter as said basket carrier upon said basket carrier, b. charging the fibers into said case and said basket carrier, c. compressing said fibers whereby said first fiber layer is formed in said basket carrier, and d. removing said case from said basket carrier.

4. The method of claim 1 wherein a treated fiber layer in condition discharged from said basket carrier is crushed and packaged after dyeing.

5. The method of claim 1 wherein the open space value before dyeing ($\epsilon_1$) is about between 0.80 and 0.47.

6. The method of claim 1 wherein said fibers are compressed at a pressure of between about 0.5 kg/cm$^2$ and 6.5 kg/cm$^2$.

7. The method of claim 6 wherein said fibers are charged in a dry condition.

8. The method of claim 6 wherein said fibers are charged in a wet condition.

9. The method of claim 1 wherein the steps of washing and rinsing are carried out in more than one treating vessel.

10. The method of claim 1 wherein said fiber is polyester staple and said value of $\epsilon_1$ is between about 0.65 and 0.75.

11. The method of claim 1 wherein said fiber is polyacrylonitrile staple and said value of $\epsilon_1$ is between about 0.47 and 0.61.

12. The method of claim 1 wherein said fiber is polyamide staple and said value of $\epsilon_1$ is between about 0.56 and 0.65.

13. The method of claim 1 wherein said fiber is wool and said value of $\epsilon_1$ is between about 0.70 and 0.80.

14. The method of claim 1 wherein said fiber is polyvinyl alcohol staple and said value of $\epsilon_1$ is between about 0.60 and 0.75.

15. The method of claim 1 wherein $\rho_{P1}$ is between about 200 g/l and 550 g/l.

16. The method of claim 1 wherein said fiber is rayon staple and said value of $\epsilon_1$ is between about 0.73 and 0.85.

* * * * *